US010465644B2

(12) United States Patent
Nah et al.

(10) Patent No.: US 10,465,644 B2
(45) Date of Patent: Nov. 5, 2019

(54) HIGH PRESSURE PUMP FOR COMPLEX INJECTION ENGINES

(71) Applicant: HYUNDAI KEFICO CORPORATION, Gunpo, Gyeonggi-do (KR)

(72) Inventors: Eun Woo Nah, Incheon (KR); Kyung Chul Han, Seoul (KR); Chun Ky Hong, Gyeonggi-do (KR)

(73) Assignee: Hyundai Kefico Corporation, Gunpo, Gyeonggi-do (KR)

( * ) Notice: Subject to any disclaimer, the term of this patent is extended or adjusted under 35 U.S.C. 154(b) by 10 days.

(21) Appl. No.: 15/634,676

(22) Filed: Jun. 27, 2017

(65) Prior Publication Data

US 2017/0292485 A1 Oct. 12, 2017

Related U.S. Application Data

(63) Continuation of application No. PCT/KR2016/015443, filed on Dec. 29, 2016.

(30) Foreign Application Priority Data

Dec. 30, 2015 (KR) ..... 10-2015-0189975

(51) Int. Cl.
*F02M 59/38* (2006.01)
*F04B 19/22* (2006.01)
(Continued)

(52) U.S. Cl.
CPC ..... *F02M 59/38* (2013.01); *F02M 37/0047* (2013.01); *F02M 39/00* (2013.01);
(Continued)

(58) Field of Classification Search
CPC .... F02M 59/38; F02M 37/0047; F02M 39/00; F02M 55/02; F02M 55/04; F02M 59/02;
(Continued)

(56) References Cited

U.S. PATENT DOCUMENTS 4,280,464 A * 7/1981 Kanai ..... F02D 41/406 123/447
9,145,860 B2 * 9/2015 Usui ..... F02M 59/462
(Continued)

FOREIGN PATENT DOCUMENTS

CN 102753813 A 10/2012
CN 203146181 U 8/2013
(Continued)

OTHER PUBLICATIONS

Office Action dated Feb. 19, 2019 in counterpart CN Patent Application No. 201680002163.0.

*Primary Examiner* — David Hamaoui
*Assistant Examiner* — John D Bailey
(74) *Attorney, Agent, or Firm* — Mintz Levin Cohn Ferris Glovsky and Popeo, P.C.; Kongsik Kim; Jhongwoo Jay Peck

(57) ABSTRACT

A high pressure pump for complex injection engines is provided. A body of the high pressure pump includes a first flow path that transports the low pressure fuel flowing in through the low pressure fuel inlet and a low pressure fuel storage chamber that is disposed in a lower portion of the body to store the low pressure fuel transported from the first flow path. A second flow path transports the low pressure fuel stored in the low pressure fuel storage chamber and a flow control valve is disposed over the low pressure fuel storage chamber to discharge the low pressure fuel, transported through the second flow path, to the pressure unit or the damper disposed in an upper portion of the body based on an opening or closing operation. A low pressure fuel outlet discharges the low pressure fuel, transported through the damper, to a low pressure fuel rail.

11 Claims, 8 Drawing Sheets

(51) Int. Cl.

| | |
|---|---|
| ***F02M 55/04*** | (2006.01) |
| ***F02M 59/46*** | (2006.01) |
| ***F02M 59/02*** | (2006.01) |
| ***F02M 55/02*** | (2006.01) |
| ***F02M 39/00*** | (2006.01) |
| ***F02M 59/10*** | (2006.01) |
| ***F02M 59/44*** | (2006.01) |
| ***F02M 63/02*** | (2006.01) |
| ***F02M 37/00*** | (2006.01) |
| ***F04B 1/053*** | (2006.01) |
| ***F04B 9/04*** | (2006.01) |
| ***F04B 11/00*** | (2006.01) |
| ***F04B 23/04*** | (2006.01) |

(52) U.S. Cl.

CPC ..... *F02M 55/02* (2013.01); *F02M 55/04* (2013.01); *F02M 59/02* (2013.01); *F02M 59/027* (2013.01); *F02M 59/10* (2013.01); *F02M 59/44* (2013.01); *F02M 59/46* (2013.01); *F02M 63/02* (2013.01); *F02M 63/0265* (2013.01); *F02M 63/0285* (2013.01); *F04B 1/053* (2013.01); *F04B 9/042* (2013.01); *F04B 11/0008* (2013.01); *F04B 11/0091* (2013.01); *F04B 19/22* (2013.01); *F04B 23/04* (2013.01)

(58) Field of Classification Search

CPC ..... F02M 59/027; F02M 59/10; F02M 59/44; F02M 59/46; F02M 63/02; F02M 63/0265; F02M 63/0285; F04B 1/053; F04B 9/042; F04B 11/0008; F04B 11/0091; F04B 19/22

USPC ..... 123/445

See application file for complete search history.

(56) References Cited

U.S. PATENT DOCUMENTS

| | | | | |
|---|---|---|---|---|
| 9,422,898 | B2 * | 8/2016 | Pursifull | F02M 39/005 |
| 9,989,022 | B2 * | 6/2018 | Spakowski | F02M 31/20 |
| 2003/0161746 | A1 | 8/2003 | Asayama et al. | |
| 2011/0097228 | A1 * | 4/2011 | Tokuo | F02M 37/0047 417/505 |
| 2011/0176944 | A1 | 7/2011 | Suzuki et al. | |
| 2012/0312278 | A1 * | 12/2012 | Usui | F02M 59/462 123/446 |
| 2013/0213361 | A1 * | 8/2013 | Zeng | F02M 63/0265 123/446 |
| 2014/0224209 | A1 * | 8/2014 | Pursifull | F02M 63/0001 123/294 |
| 2014/0224217 | A1 * | 8/2014 | Pursifull | F02M 39/005 123/446 |
| 2014/0255219 | A1 * | 9/2014 | Lucas | F02M 59/366 417/282 |
| 2015/0075484 | A1 * | 3/2015 | VanDerWege | F02M 63/0001 123/294 |
| 2016/0010607 | A1 * | 1/2016 | Lucas | F02M 59/366 417/53 |
| 2016/0131097 | A1 * | 5/2016 | Matsuo | F02M 59/025 123/495 |
| 2016/0245218 | A1 * | 8/2016 | Ulrey | F02M 59/022 |
| 2016/0290299 | A1 * | 10/2016 | Aritomi | F02M 59/367 |
| 2016/0363104 | A1 * | 12/2016 | Sanborn | F02M 37/0041 |
| 2016/0377017 | A1 * | 12/2016 | Basmaji | F02D 41/3845 701/103 |
| 2016/0377018 | A1 * | 12/2016 | Sanborn | F02M 63/0285 123/457 |
| 2016/0377019 | A1 * | 12/2016 | Russ | F02D 41/3094 123/486 |
| 2017/0022926 | A1 * | 1/2017 | Sanborn | F02D 41/3845 |
| 2017/0022927 | A1 * | 1/2017 | Sanborn | F02M 59/20 |
| 2017/0167450 | A1 * | 6/2017 | Spakowski | F02M 31/20 |
| 2017/0204803 | A1 * | 7/2017 | Pursifull | F02D 41/3845 |
| 2017/0292468 | A1 * | 10/2017 | Lee | F02D 41/3005 |
| 2017/0306905 | A1 * | 10/2017 | Usui | F02M 37/00 |
| 2018/0066598 | A1 * | 3/2018 | Dusa | F02D 41/064 |

FOREIGN PATENT DOCUMENTS

| | | | |
|---|---|---|---|
| CN | 103982304 | A | 8/2014 |
| JP | 2001-295770 | A | 10/2001 |
| JP | 2011-179319 | A | 9/2011 |
| KR | 10-1361612 | B1 | 2/2014 |
| KR | 10-1511962 | B1 | 4/2015 |

* cited by examiner

515: C, 515A,515B,515C,515D

HIGH PRESSURE PUMP FOR COMPLEX INJECTION ENGINES

CROSS-REFERENCE TO RELATED APPLICATION(S)

This application is a continuation of application no. PCT/KR2016/015443, filed on Dec. 29, 2016, which is based on and claims the benefit of priority to Korean Patent Application No. 10-2015-0189975, filed on Dec. 30, 2015, in the Korean Intellectual Property Office, the disclosure of which is incorporated herein in its entirety by reference.

TECHNICAL FIELD

The present invention relates to a high pressure pump for complex injection engines, and more particularly, to a high pressure pump for complex injection engines, in which port fuel injection (PFI) and gasoline direct injection (GDI) are combined.

BACKGROUND ART

Generally, fuel injection of vehicle engines are categorized into PFI and GDI. The PFI is an injection method which is mainly used in gasoline engines, and is an injection method that injects low pressure fuel into an intake port to supply a mixed air including air to the inside of a cylinder. The GDI is an injection method which is mainly used in diesel engines, and is an injection method that directly injects high pressure fuel into a cylinder. Hereinafter, an engine using the PFI is referred to as a PFI engine, and an engine using the GDI is referred to as a GDI engine.

In a partial load, the GDI engine injects fuel at a last stage of a compression stroke and thus easily ignites even at an ultra-lean air-fuel ratio through stratified charge combustion which allows an air-fuel ratio around an ignition plug to be sufficient. In a high load, the GDI engine injects fuel at an initial stage of an intake stroke and thus cools intake air through an air-fuel ratio for complete combustion, thereby enhancing filling efficiency. The GDI engine directly injects fuel into a cylinder, and thus, decreases a wall wetting phenomenon where fuel is adsorbed onto an intake port wall.

Despite such advantages, the GDI engine injects fuel into a cylinder in an intake stroke section, and thus, the GDI engine is lower in homogenization performance than a conventional PFI engine. Accordingly, in gasoline engines, a complex injection engine where the PFI and the GDI are combined has been developed.

As described above, since the PFI engine uses a method of injecting low pressure fuel into an intake port, in a fuel supply system based on the PFI engine, low pressure fuel to which fuel stored in a fuel tank is changed is transported to a low pressure injector that injects the low pressure fuel into the intake port, and thus, a low pressure fuel supply line that transports the low pressure fuel to the low pressure injector is required to be developed. Additionally, since the GDI engine uses a method of injecting high pressure fuel into a cylinder, high pressure fuel to which fuel stored in a fuel tank is changed is transported to a high pressure injector that injects the high pressure fuel into the cylinder, and thus, a high pressure fuel supply line that transports the high pressure fuel to the cylinder is required to be developed. Therefore, in a related art fuel supply system for complex injection engines in which the PH and the GDI are combined, the low pressure fuel supply line and the high pressure fuel supply line should be simultaneously designed, and for this reason, designs of all fuel supply lines is complex.

SUMMARY

An object of the present invention is to provide a high pressure pump for complex injection engines, in which a portion of a low pressure fuel supply line is designed in a high pressure pump configuring a portion of a high pressure fuel supply line, thereby enabling fuel supply lines to be designed in a simplified manner.

Accordingly, in a high pressure pump for complex injection engines according to one aspect of the present invention, including a pressure unit that applies pressure to low pressure fuel flowing in from a low pressure fuel inlet to generate high pressure fuel, a damper that dampens a pulsation generated when applying the pressure to the low pressure fuel, and a high pressure fuel outlet through which the high pressure fuel obtained by the pressure unit applying the pressure to the low pressure fuel is discharged to a high pressure fuel rail, a body of the high pressure pump may include: a first flow path that transports the low pressure fuel flowing in through the low pressure fuel inlet; a low pressure fuel storage chamber disposed in a lower portion of the body to store the low pressure fuel transported from the first flow path; a second flow path that transports the low pressure fuel stored in the low pressure fuel storage chamber; a flow control valve disposed over the low pressure fuel storage chamber to discharge the low pressure fuel, transported through the second flow path, to the pressure unit or the damper disposed in an upper portion of the body based on an opening or closing operation; and a low pressure fuel outlet that discharges the low pressure fuel, transported through the damper, to a low pressure fuel rail.

In a high pressure pump for complex injection engines according to another aspect of the present invention, a body of the high pressure pump may include: a damper supplied with the low pressure fuel through the low pressure fuel inlet; a flow control valve disposed under the damper to discharge the low pressure fuel, transported through the damper, to the pressure unit or a first flow path based on an opening or closing operation; a low pressure fuel storage chamber disposed in a lower portion of the body to store the low pressure fuel transported from the first flow path; a second flow path that transports the low pressure fuel stored in the low pressure fuel storage chamber; and a low pressure fuel outlet that discharges the low pressure fuel, transported through the second flow path to a low pressure fuel rail.

According to the present invention, a low pressure fuel supply line is provided in a high pressure pump, and thus, fuel supply lines in a fuel system for complex injection engines may be designed in a simplified manner.

BRIEF DESCRIPTION OF DRAWINGS

The above and other objects, features and advantages of the present disclosure will be more apparent from the following detailed description taken in conjunction with the accompanying drawings.

DETAILED DESCRIPTION

Figure 1:
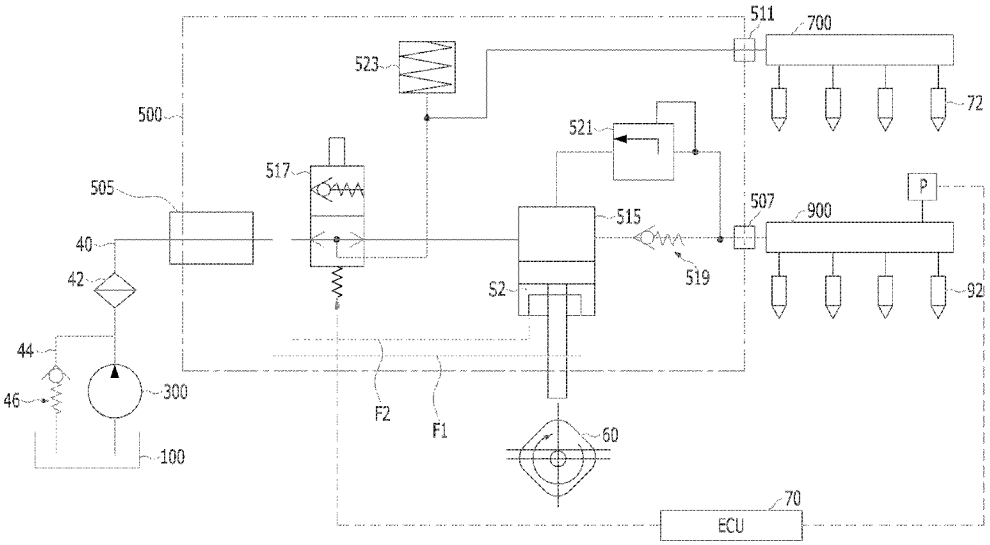
FIG. 1 is a block diagram of a fuel system for complex injection engines according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Advantages and features of the present invention, and implementation methods thereof will be clarified through following exemplary embodiments described with reference to the accompanying drawings. The present invention may, however, be embodied in different forms and should not be construed as limited to the exemplary embodiments set forth herein. Rather, these exemplary embodiments are provided so that this disclosure will be thorough and complete, and will fully convey the scope of the present invention to those skilled in the art. Further, the present invention is only defined by scopes of claims. In the following description, the technical terms are used only for explaining a specific exemplary embodiment while not limiting the present invention.

Hereinafter, exemplary embodiments of the present invention will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present invention.

FIG. 1 is a block diagram of a fuel system for complex injection engines according to an exemplary embodiment of the present invention. Referring to FIG. 1, in the fuel system for complex injection engines according to an exemplary embodiment of the present invention, a low pressure fuel supply line for transporting low pressure fuel may be disposed in a high pressure pump 500, for simplifying all fuel supply lines. In particular, the fuel system for complex injection engines according to an exemplary embodiment of the present invention may include a low pressure pump 300, the high pressure pump 500 including the low pressure fuel supply line, and fuel rails 700 and 900.

The low pressure pump 300 may be configured to apply low pressure to fuel supplied from a fuel tank 100 and supply the low pressure-applied fuel (hereinafter referred to as low pressure fuel) to the high pressure pump 500 through a fuel tank supply line 40. In particular, a fuel filter 42 that removes impurities of the low pressure fuel may be disposed on the fuel tank supply line 40, and a return line 44 that branches from the fuel tank supply line 40 between the low pressure pump 300 and the fuel filter 42 may be disposed on the fuel tank supply line 40. A first pressure limit valve 46 may be disposed on the return line 44.

Further, the return line 44 and the pressure limit valve 46 prevent a pressure pulsation of the low pressure fuel supplied from the low pressure pump 300 from being transferred to the high pressure pump 500. In other words, the return line 44 returns the low pressure fuel having the pressure pulsation to the fuel tank 100, and the pressure limit valve 46 adjusts a flow of the low pressure fuel for the low pressure fuel having the pressure pulsation to return in only a direction toward the fuel tank 100 and executes an adjustment to prevent the low pressure fuel from flowing in a direction opposite to the direction toward the fuel tank 100. Therefore, the pressure limit valve 46 may prevent the low pressure fuel having the pressure pulsation from being supplied toward the high pressure pump 500. The high pressure pump 500 may be configured to compress the low pressure fuel supplied from the low pressure pump 300 with high pressure and supply the high pressure-compressed fuel (hereinafter referred to as high pressure fuel) to the high pressure fuel rail 900 via a high pressure fuel line designed in the high pressure pump 500.

Particularly, a low pressure fuel supply line according to an exemplary embodiment of the present invention is additionally designed in the high pressure pump 500, and thus, the low pressure fuel supplied through the low pressure fuel supply line from the low pressure pump 300 may be supplied to the low pressure fuel rail 700. The high pressure pump 500 will be described below in detail. The fuel rails 700 and 900 include the low pressure fuel rail (a PFI rail) 700 and the high pressure fuel rail (a GDI rail) 900. The low pressure fuel rail 700 may be configured to inject the low pressure fuel, supplied from the high pressure pump 500, into an intake port through a plurality of low pressure injectors 72. The high pressure fuel rail 900 may be configured to directly inject the high pressure fuel, supplied from the high pressure pump 500, into a cylinder through a plurality of high pressure injectors 92.

Figure 2:
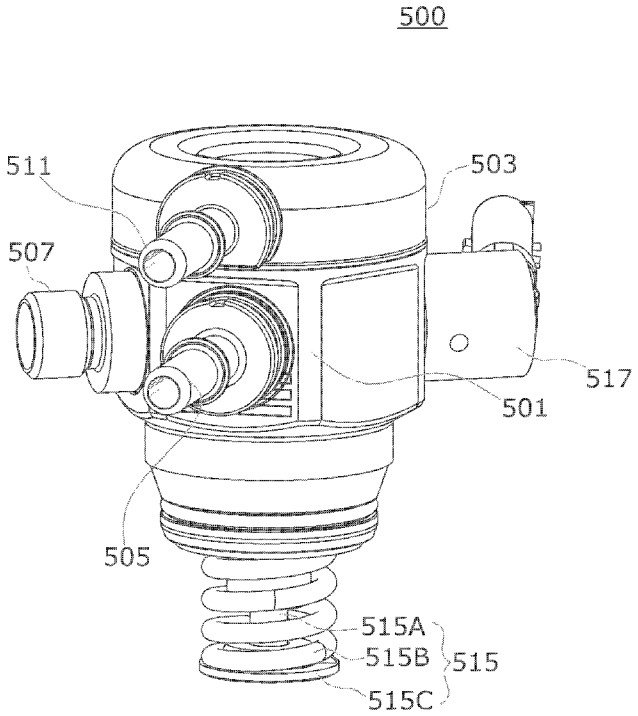
FIG. 2 is a perspective view illustrating a whole appearance of a high pressure pump illustrated in FIG. 1 according to an exemplary embodiment of the present invention.

Hereinafter, the high pressure pump 500 illustrated in FIG. 1 will be described in detail. FIG. 2 is a perspective view illustrating a whole appearance of a high pressure pump illustrated in FIG. 1, and FIG. 3 is a plan view when the high pressure pump illustrated in FIG. 2 is seen from above.

Figure 3:
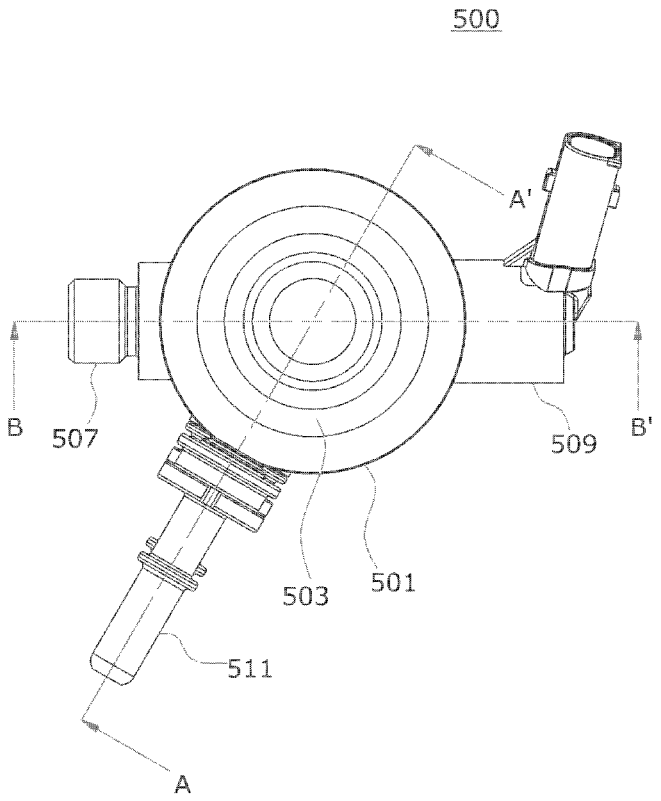
FIG. 3 is a plan view when the high pressure pump illustrated in FIG. 2 is seen from above according to an exemplary embodiment of the present invention.

Referring to FIGS. 1 to 3, the high pressure pump 500 according to an exemplary embodiment of the present invention may include a body 501 and a cover 503 that covers an upper portion of the body 501. The cover 503 may cover a damper 523 (illustrated in FIGS. 4 to 6) disposed over the body 501. A low pressure fuel inlet (or a PFI inlet) 505 through which fuel flows in from the low pressure pump 300 illustrated in FIG. 1 and a high pressure fuel outlet (or GDI outlet) 507 through which the high pressure fuel obtained by applying high pressure to the low pressure fuel flows out to the high pressure fuel rail 900 may be disposed on a side surface of the body 501 (e.g., a first side surface of the body).

Moreover, a flow control valve 517 may be disposed on the side surface of the body 501 (e.g., a second side surface of the body), and a low pressure fuel outlet (a PFI outlet) 511 through which the low pressure fuel flows out to the low pressure fuel rail 700 may be disposed on a side surface of the cover 503 (e.g., a first side surface of the cover). Moreover, a pump piston 515A that protrudes from the inside of the body 501, a retainer 515C fixedly coupled to a lower end of the pump piston 515A, and a return spring 515B having a first end by supported by the retainer 515C and a second end supported by a partition wall 515D (illustrated in FIGS. 4 and 5) provided under the body 501 may be disposed under the body 501.

The pump piston 515A may be driven by, for example, a rotation of a cam 60 (illustrated in FIG. 1) of a combustion engine (not shown). An elastic force of the return spring 515B may be provided to the pump piston 515A through the retainer 515C. The pump piston 515A, the return spring 515B, and the retainer 515C are elements included in a below-described pressure unit 515, and their detailed structures are illustrated in FIGS. 4 to 6.

Hereinafter, an internal structure of the high pressure pump according to an exemplary embodiment of the present invention will be described in more detail with reference to FIGS. 1 and 4 to 6. FIG. 4 is a cross-sectional view taken along line A-A' illustrated in FIG. 3 and FIG. 5 is a cross-sectional view taken along line B-B' illustrated in FIG. 3. In addition, FIG. 6 is a three-dimensional cross-sectional view taken along line A-B' illustrated in FIG. 3. To help understand description, the description will be made with reference to FIGS. 2 to 6 along with FIG. 1.

The body 501 of the high pressure pump 500 according to an exemplary embodiment of the present invention may include a first low pressure fuel storage chamber S1, a first descending flow path F1, a pressure unit 515, a second low pressure fuel storage chamber S2, an ascending flow path F2, a flow control valve 517, a unidirectional check valve 519, a pressure relief valve 521, a third low pressure fuel storage chamber S3, and a damper 523.

Figure 4:
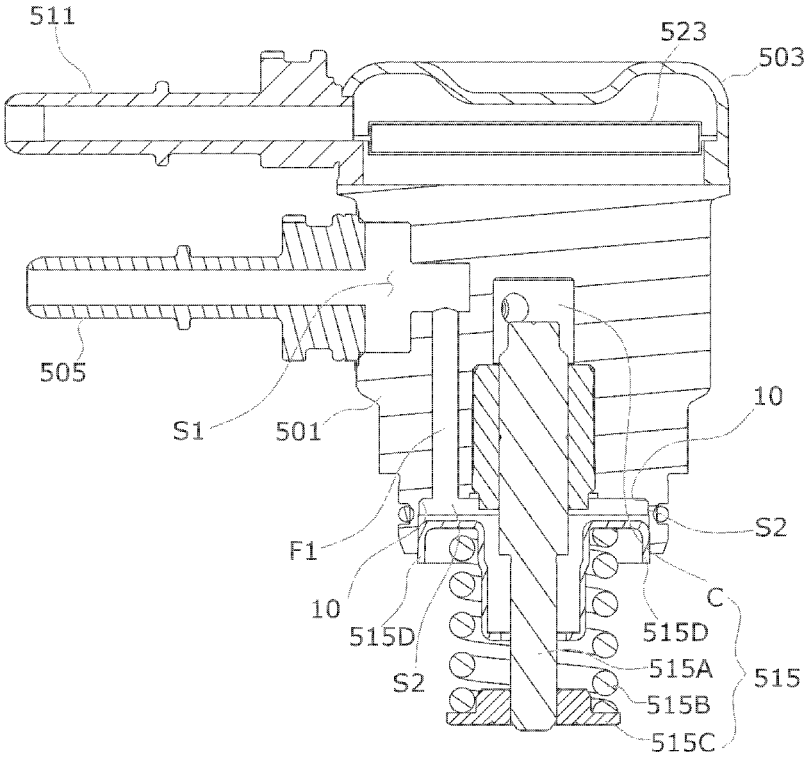
FIG. 4 is a cross-sectional view taken along line A-A' illustrated in FIG. 3 according to an exemplary embodiment of the present invention.
Figure 5:
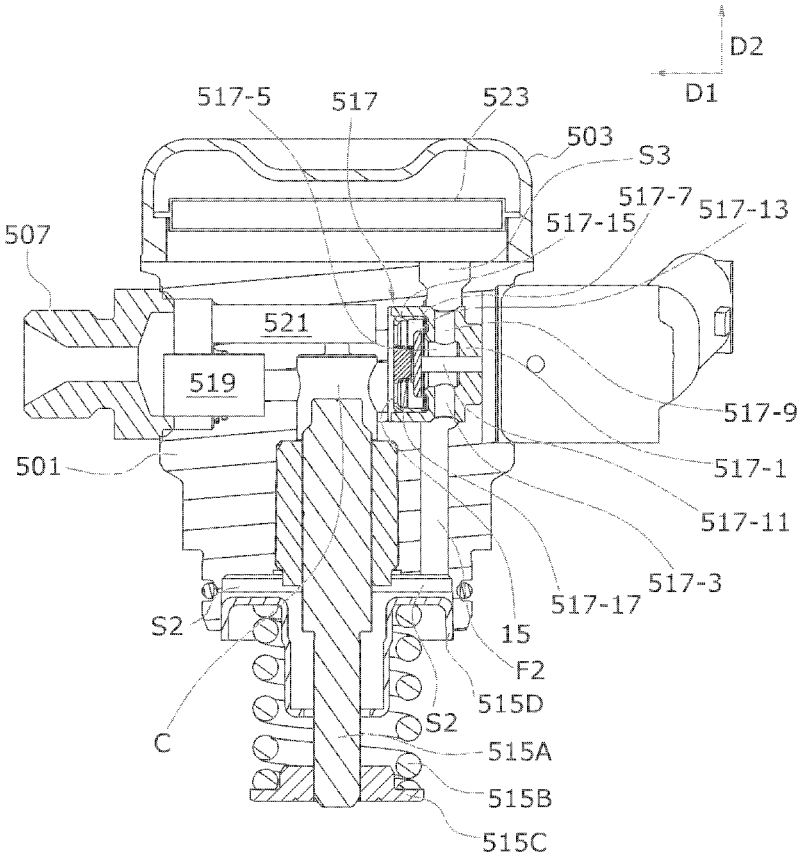
FIG. 5 is a cross-sectional view taken along line B-B' illustrated in FIG. 3 according to an exemplary embodiment of the present invention.
Figure 6:
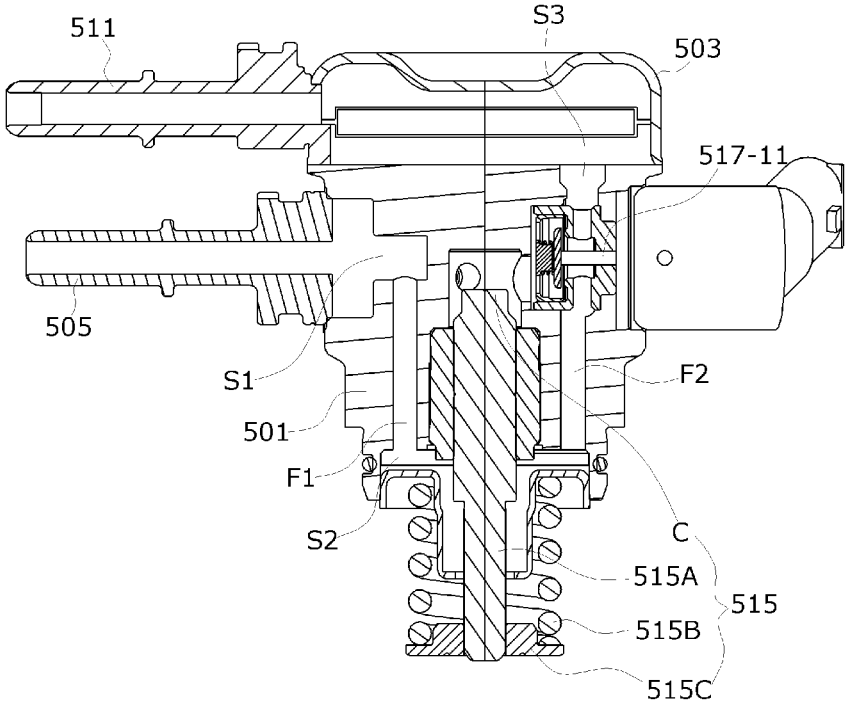
FIG. 6 is a three-dimensional cross-sectional view taken along line A-B' illustrated in FIG. 3 according to an exemplary embodiment of the present invention.

Particularly, referring to FIGS. 1, 4, and 6, the first low pressure fuel storage chamber S1 may be configured to communicate with the low pressure fuel inlet 505 and store low pressure fuel which flows in through the low pressure fuel inlet 505. The descending flow path F1 may connect the first low pressure fuel storage chamber S1 to the second low pressure fuel storage chamber S2 disposed under the first low pressure fuel storage chamber S1 and transport the low pressure fuel stored in the first low pressure fuel storage chamber S1 to the second low pressure fuel storage chamber S2.

The pressure unit 515 may be configured to apply or exert pressure to the low pressure fuel discharged from the flow control valve 517 to generate high pressure fuel and may include the pump piston 515A passing through the second low pressure fuel storage chamber S2, a chamber C disposed over the second low pressure fuel storage chamber S2 and having a varied volume based on a rectilinear motion of the pump piston 515A, the retainer 515C fixedly coupled to the lower end of the pump piston 515A, the partition wall 515D spaced apart from a lower surface of 10 of the body 501 by a particular interval and configures the second low pressure fuel storage chamber S2, and the return spring 515B having the first end by supported by the retainer 515C and the second end supported by the partition wall 515D.

Particularly, since the pump piston 515A passes vertically through a center of the second low pressure fuel storage chamber S2 configured by the lower surface 10 of the body 501 and the partition wall 515D, a ring-shaped flow path formed along a circumference of the pump piston 515A may be disposed in the second low pressure fuel storage chamber S2. The second low pressure fuel storage chamber S2 providing the ring-shaped flow path may connect the ascending flow path F2 and the descending flow path F1 extending in a direction parallel to a lengthwise direction of the pump piston 515A. Therefore, the second low pressure fuel storage chamber S2 may be configured to supply the low pressure fuel, supplied from the descending flow path F1, to the ascending flow path F2. Since FIG. 4 is a cross-sectional view taken along line A-A' illustrated in FIG. 3, the ascending flow path F2 is not illustrated in FIG. 4.

Referring to FIGS. 1, 5, and 6, the ascending flow path F2 may be configured to supply the low pressure fuel, supplied from the second low pressure fuel storage chamber S2, to the flow control valve 517. The flow control valve 517 may be configured to adjust a supply flow rate, a discharging pressure, and a supply direction of the low pressure fuel supplied from the ascending flow path F2 based on a control by an electronic control unit (ECU) 70 (illustrated in FIG. 1). For example, the flow control valve 517 may be an electronic control valve such as a solenoid valve. The supply direction adjusted by the flow control valve 517 may include a direction, in which the low pressure fuel transported through the ascending flow path F2 is supplied toward the high pressure fuel rail 900 via the chamber C, and a direction in which the low pressure fuel transported through the ascending flow path F2 is supplied toward the low pressure fuel rail 700 via the damper 523.

Accordingly, the flow control valve 517 may include a valve body 517-1 having an inflow aperture 517-3 through which the low pressure fuel from the ascending flow path F2 flows in (e.g., enters), a fluid movement path 517-5 which provides a movement path for the low pressure fuel flowing in through the inflow aperture 517-3, a control chamber 517-7 which provides the flow pressure fuel flowing in through the fluid movement path 517-5 to be discharged in a direction toward the chamber C, and a discharging aperture 517-9 (e.g., a second discharging aperture) through which the low pressure fuel flowing in through the fluid movement path 517-5 may be discharged to the third low pressure fuel storage chamber S3.

Moreover, the flow control valve 517 may include a needle 517-11 which rectilinearly moves in a first direction D1 in the fluid movement path 517-5, and the needle 517-11 may be a cylindrical rod. In particular, the needle 517-11 is not illustrated in FIG. 5, and is illustrated in only FIG. 6. Moreover, the flow control valve 517 may include a valve plate 517-13 disposed in a first end of the needle 517-11. The valve plate 517-13 may be configured to move rectilinearly based on a rectilinear motion of the needle 517-11 and may shuttle between an opened position and a closed position of the fluid movement path 517-5 based on a rectilinear motion of the valve plate 517-13.

As described above, the control chamber 517-7 may include a stopper 517-15, and a discharging aperture 15 (e.g., a first discharging aperture) through which the low pressure fuel is discharged in the direction toward the chamber C may be disposed in a first side of the control chamber 517-1, for discharging the low pressure fuel flowing in through the fluid movement path 517-5 in the direction toward the chamber C. An elastic component 517-15 may be disposed between the stopper 517-15 and the valve plate 517-13. The elastic component 517-17 may be a coil spring, but is not limited thereto.

To briefly describe an operation of the flow control valve 517 according to an exemplary embodiment of the present invention, in a process where the pump piston 515A moves from a top dead point position to a bottom dead point position of the chamber C based on a rotation of the cam 60 (illustrated in FIG. 1), the needle 517-11 and the valve plate 517-13 may be configured to move in the first direction D1 based on a control by the ECU 70 (illustrated in FIG. 1), and thus, the fluid movement path 517-5 may be configured to communicate with the control chamber 517-7. Therefore, a flow patch that connects the fluid movement path 517-5, the control chamber 517-7, the discharging aperture 15, and the chamber C is provided. In particular, a space in the chamber C increases, and thus, internal pressure of the chamber C decreases. When the reduced internal pressure of the chamber C is less than pressure of the control chamber 517-7, the low pressure fuel flowing in through the ascending flow path F2 moves to the chamber C via the fluid movement path 517-5, the control chamber 517-7, and the discharging aperture 15.

When the pump piston 515A moves from the bottom dead point position to the top dead point position in the chamber C based on a rotation of the cam 60 (illustrated in FIG. 1), as the internal pressure of the chamber C increases due to a reduction in the space in the chamber C, the high pressure fuel obtained by applying pressure to the low pressure fuel which has moved to the chamber C is supplied to the below-described unidirectional check valve 519.

Further, the unidirectional check valve 519 may be configured to supply the high pressure fuel, supplied from the chamber C, to the high pressure fuel rail 900 via the high pressure fuel outlet 507. When the unidirectional check valve 519 discharges the high pressure fuel to the high pressure fuel outlet 507 and the pressure of the high pressure fuel is greater than a particular pressure, the pressure relief valve 521 may again return the high pressure fuel greater than the particular pressure (e.g., a reference pressure) to the chamber C. Structures of the unidirectional check valve 519 and the pressure relief valve 521 are well known, and thus, their detailed descriptions are omitted.

A flow path including the inflow aperture 517-3 and the discharging aperture 517-9 may be provided in a second direction D2. Therefore, in an operation of the flow control valve 517, the needle 517-11 and the valve plate 517-13 move in a direction opposite to the first direction D1 (e.g., a second direction) based on a control by the ECU 70 (illustrated in FIG. 1), and when communication between the fluid movement path 517-5 and the control chamber 517-7 is blocked, the low pressure fuel supplied from the ascending flow path F2 may move to the damper 523 via the third low pressure fuel storage chamber S3 due to the flow path having the second direction D2. The damper 523, as well known, is an element that dampens a pulsation of the low pressure fuel supplied through the third low pressure fuel storage chamber S3 from the flow control valve 517. The damper 523 may be configured to supply the damped low pressure fuel to the low pressure fuel rail 700 via the low pressure fuel outlet 511.

As described above, according to an exemplary embodiment of the present invention, in addition to the high pressure fuel supply line including the low pressure fuel inlet 505, the first low pressure fuel storage chamber S1, the descending flow path F1, the second low pressure fuel storage chamber S2, the flow control valve 517, the chamber C, the unidirectional check valve 519, and the high pressure fuel outlet 507, the low pressure fuel supply line including the low pressure fuel inlet 505, the first low pressure fuel storage chamber S1, the descending flow path F1, the second low pressure fuel storage chamber S2, the ascending flow path F2, the flow control valve 517, the third low pressure fuel storage chamber S3, the damper 521, and the low pressure fuel outlet 511 is designed in the high pressure pump 500, and thus, all fuel supply lines may be designed in a simplified manner.

Figure 7:
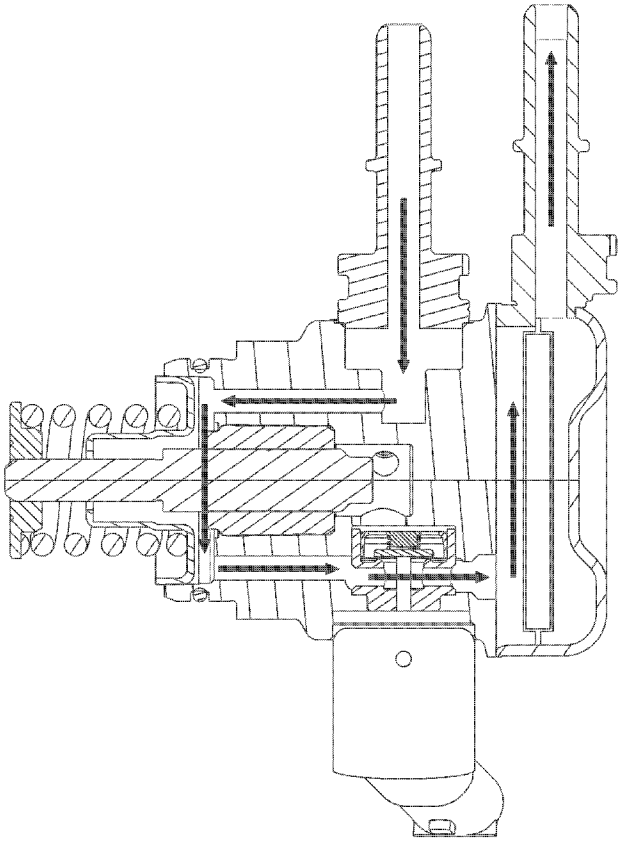
FIG. 7 is a flowchart illustrating a fuel flow of low pressure fuel in a high pressure pump according to an exemplary embodiment of the present invention.

In FIG. 7, a flow of the low pressure fuel moving through the low pressure fuel supply line configured in the order of the low pressure fuel inlet 505, the first low pressure fuel storage chamber S1, the descending flow path F1, the second low pressure fuel storage chamber S2, the ascending flow path F2, the flow control valve 517, the third low pressure fuel storage chamber S3, the damper 521, and the low pressure fuel outlet 511 in the high pressure pump 500 according to an exemplary embodiment of the present invention is illustrated as an arrow.

Figure 8:
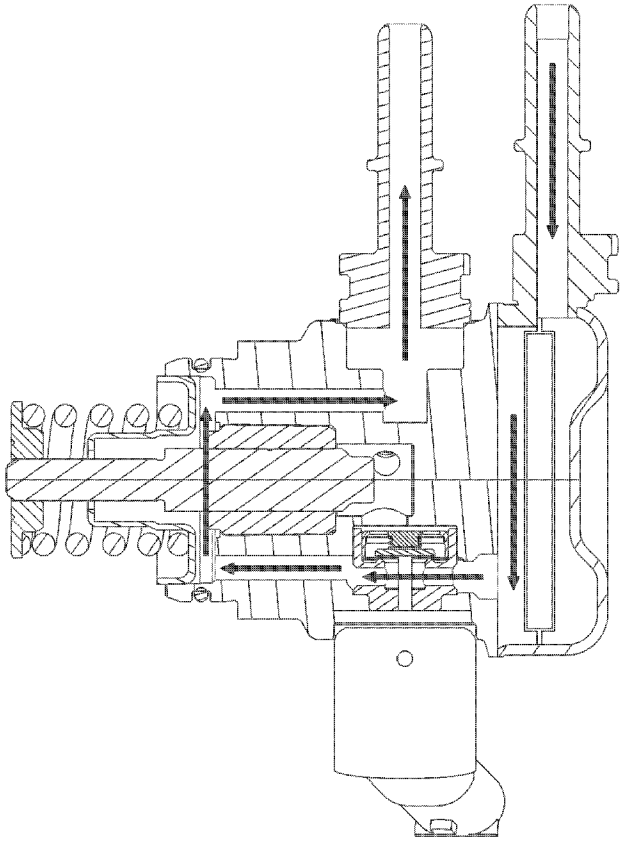
FIG. 8 is a flowchart illustrating a fuel flow of low pressure fuel in a high pressure pump according to another exemplary embodiment of the present invention.

FIG. 8 is a flowchart illustrating a fuel flow of low pressure fuel in a high pressure pump according to another exemplary embodiment of the present invention, and in another exemplary embodiment of the present invention, there is a difference in that the low pressure fuel inlet 505 described above with reference to FIG. 7 operates as an outlet through which the low pressure fuel may be discharged to the low pressure fuel rail 700, and the low pressure fuel outlet 511 described above with reference to FIG. 7 may operate as an inlet through which the low pressure fuel may enter.

Therefore, in a high pressure pump 500 according to another exemplary embodiment of the present invention, low pressure fuel may move to the low pressure fuel rail 700 through a low pressure fuel supply line configured in the order of the low pressure fuel outlet 511, the damper 521, the third low pressure fuel storage chamber S3, the flow control valve 517, the ascending flow path F2, the second low pressure fuel storage chamber S2, the descending flow path F1, the first low pressure fuel storage chamber S1, and the low pressure fuel inlet 505. Accordingly, the low pressure pump may be connected to the low pressure fuel outlet 511, and even when the low pressure fuel rail 700 is connected to the low pressure fuel inlet 505, difficulties in implementing the low pressure fuel supply line in the high pressure pump may be prevented in the present invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A high pressure pump for complex injection engines, including a pressure unit configured to apply pressure to low pressure fuel flowing in from a low pressure fuel inlet to generate high pressure fuel, a damper configured to dampen a pulsation generated when applying the pressure to the low pressure fuel, a high pressure fuel outlet through which the high pressure fuel obtained by the pressure unit is discharged to a high pressure fuel rail, and a body of the high pressure pump comprising:

a first flow path that transports the low pressure fuel flowing in through the low pressure fuel inlet;

a low pressure fuel storage chamber disposed in a lower portion of the body to store the low pressure fuel transported from the first flow path;

a second flow path that transports the low pressure fuel stored in the low pressure fuel storage chamber, wherein the first flow path and the second flow path are separately formed within the body;

a flow control valve disposed over the low pressure fuel storage chamber to discharge the low pressure fuel, transported through the second flow path, to the pressure unit or the damper disposed in an upper portion of the body based on an opening or closing operation, wherein the flow control valve includes an inflow aperture connected to the second flow path, a first discharging aperture connected to the pressure unit, and a second discharging aperture connected to the damper; and a low pressure fuel outlet that discharges the low pressure fuel, transported through the damper, to a low pressure fuel rail.

2. The high pressure pump for complex injection engines of claim 1, wherein the pressure unit includes:

a pump piston that passes through the low pressure fuel storage chamber; and a chamber disposed over the low pressure fuel storage chamber, wherein a volume of the chamber changes based on a rectilinear motion of the pump piston, and the low pressure fuel storage chamber provides a ring-shaped flow path provided along a circumference of the pump piston.

3. The high pressure pump for complex injection engines of claim 1, wherein the pressure unit further includes a partition wall spaced apart from a lower surface of the body by a particular interval, and the low pressure fuel storage chamber is a space provided between the lower surface of the body and the partition wall.

4. The high pressure pump for complex injection engines of claim 2, wherein the first and second flow paths extend in a parallel direction to a lengthwise direction of the pump piston.

5. The high pressure pump for complex injection engines of claim 1, wherein a valve body of the flow control valve includes:

a fluid movement path that provides a movement path for the low pressure fuel flowing in through the inflow aperture;

a needle configured to move rectilinearly in the fluid movement path;

a valve plate configured to move rectilinearly based on a rectilinear motion of the needle; and a control chamber configured to communicate with the fluid movement path based on a rectilinear motion of the valve plate;

wherein the inflow aperture receives the low pressure fuel transported from the second flow path, the first discharging aperture discharges the low pressure fuel flowing into the control chamber via the fluid movement path, and the second discharging aperture discharges the low pressure fuel, flowing into the fluid movement path, to the damper.

6. The high pressure pump for complex injection engines of claim 5, wherein when the needle moves rectilinearly in a first direction and the valve plate moves rectilinearly in the first direction, the fluid movement path communicates with the control chamber, and when the needle moves rectilinearly in an opposite direction of the first direction and the valve plate moves rectilinearly in the opposite direction, communication between the fluid movement path and the control chamber is blocked, whereby the low pressure fuel flowing into the fluid movement path is discharged to the damper through the second discharging aperture.

7. The high pressure pump for complex injection engines of claim 1, further comprising:

a cover that covers the damper disposed over the body, wherein the low pressure fuel inlet is disposed in a side surface of the body, and the low pressure fuel outlet is disposed in a side surface of the cover.

8. A high pressure pump for complex injection engines, including a pressure unit configured to apply pressure to low pressure fuel flowing in from a low pressure fuel inlet to generate high pressure fuel, a high pressure fuel outlet through which the high pressure fuel obtained by the pressure unit is discharged to a high pressure fuel rail, and a body of the high pressure pump comprising:

a damper supplied with the low pressure fuel through the low pressure fuel inlet;

a flow control valve disposed under the damper to discharge the low pressure fuel, transported through the damper, to the pressure unit or a first flow path based on an opening or closing operation, wherein the flow control valve includes an inflow aperture connected to the damper, a first discharge aperture connected to the pressure unit, and a second discharge aperture connected to the first flow path;

a low pressure fuel storage chamber disposed in a lower portion of the body to store the low pressure fuel transported from the first flow path;

a second flow path that transports the low pressure fuel stored in the low pressure fuel storage chamber, wherein the first flow path and the second flow path are separately formed within the body; and a low pressure fuel outlet that discharges the low pressure fuel, transported through the second flow path to a low pressure fuel rail.

9. The high pressure pump for complex injection engines of claim 8, further comprising:

a cover that covers the damper disposed in an upper portion of the body, wherein the low pressure fuel inlet is disposed in a side surface of the cover, and the low pressure fuel outlet is disposed in a side surface of the body.

10. The high pressure pump for complex injection engines of claim 8, wherein the pressure unit includes:

a pump piston that passes through the low pressure fuel storage chamber; and a chamber disposed over the low pressure fuel storage chamber, wherein a volume of the chamber changes based on a rectilinear motion of the pump piston, and the low pressure fuel storage chamber provides a ring-shaped flow path disposed along a circumference of the pump piston.

11. The high pressure pump for complex injection engines of claim 10, wherein the first and second flow paths extend in a parallel direction to a lengthwise direction of the pump piston.

* * * * *